US006661171B2

(12) United States Patent
Hecker

(10) Patent No.: US 6,661,171 B2
(45) Date of Patent: Dec. 9, 2003

(54) INTEGRAL STARTING AID FOR HIGH INTENSITY DISCHARGE LAMPS

(75) Inventor: Arlene Hecker, Beverly, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/063,367

(22) Filed: Apr. 16, 2002

(65) Prior Publication Data

US 2003/0193292 A1 Oct. 16, 2003

(51) Int. Cl.[7] ..... H01K 1/50
(52) U.S. Cl. ..... 313/594; 313/607
(58) Field of Search ..... 315/248; 313/594, 313/607

(56) References Cited

U.S. PATENT DOCUMENTS 6,456,005 B1 * 9/2002 Panchula et al. ..... 313/567

OTHER PUBLICATIONS

Abstract, JP 03–004439 (Jan. 10, 1991).

* cited by examiner

*Primary Examiner*—David Hung Vu
(74) *Attorney, Agent, or Firm*—Robert F. Clark

(57) ABSTRACT

A integral starting aid for high intensity discharge lamps is provided wherein the starting aid comprises a conductive, refractory metal nitride stripe which is directly applied to the surface of the ceramic arc tube. Preferably, the starting aid comprises titanium nitride or zirconium nitride and may be mixed a ceramic material to improve translucency.

7 Claims, 1 Drawing Sheet

INTEGRAL STARTING AID FOR HIGH INTENSITY DISCHARGE LAMPS

BACKGROUND OF INVENTION

Conventional starting aids for high intensity discharge lamps, and in particular high pressure sodium (HPS) lamps, have traditionally consisted of a tungsten wire wrapped around, or positioned alongside, the ceramic arc tube. The tungsten wire is welded to a frame member or an electrode feedthrough during the manufacturing process to provide electrical contact with the lamp's power supply. This basic type of starting aid has been manufactured for many years and generally performs reliably over the life of the lamp. However, pure tungsten wire is relatively expensive and labor and time are required to form the welds.

More recently, lamp manufacturers have used an integral starting aid which consists of a printed stripe directly sintered to the ceramic arc tube. The stripe is made of either pure tungsten or a tungsten/alumina cermet. For example, U.S. Pat. No. 5,541,480, which is incorporated herein by reference, describes a polycrystalline alumina (PCA) arc tube having an integral tungsten ignition aid which is applied as a tungsten-containing paste prior to sintering the arc tube to translucency. These integral starting aids reduce the costs of manufacturing but may not perform as reliably as tungsten wire starting aids. In particular, because the starting aid is applied as a thin stripe directly to the surface, any mismatch in the thermal expansion coefficients of the ceramic arc tube and starting aid materials becomes important. The high temperature of the operating arc tube coupled with the on-off thermal cycling which occurs throughout the operating life of the lamp can cause the thin stripe to break and lose electrical continuity thereby rendering it inoperable. In addition, the geometry of the starting aid is also limited by thermal expansion mismatches. If the starting aid is applied too thickly, the induced stress from the thermal expansion mismatch can cause the arc tube to crack. Therefore, it would be desirable for the material comprising the starting aid to have a thermal expansion coefficient which closely matches that of the arc tube material.

SUMMARY OF INVENTION

It is an object of the invention to obviate the disadvantages of the prior art.

It is another object of the invention to provide an integral starting aid for high intensity discharge lamps wherein the thermal expansion coefficient of the starting aid material is closely matched to that of the ceramic arc tube.

It is still another object of the invention to provide an integral starting aid which is capable of withstanding the high temperatures and thermal cycling of the operating arc tubes of high intensity discharge lamps.

In accordance with one object of the invention, there is provided an integral starting aid comprised of a conductive, refractory metal nitride stripe applied directly to the surface of a ceramic arc tube. The metal nitride stripe may be applied by a number of conventional means including aerosol spraying, ink pen, ink-jet, or vapor deposition. In one aspect, the integral starting aid is comprised of a thin stripe containing titanium nitride or zirconium nitride. The starting aid is sintered with the ceramic arc tube to bond it to the arc tube surface.

DETAILED DESCRIPTION

Figure 1:
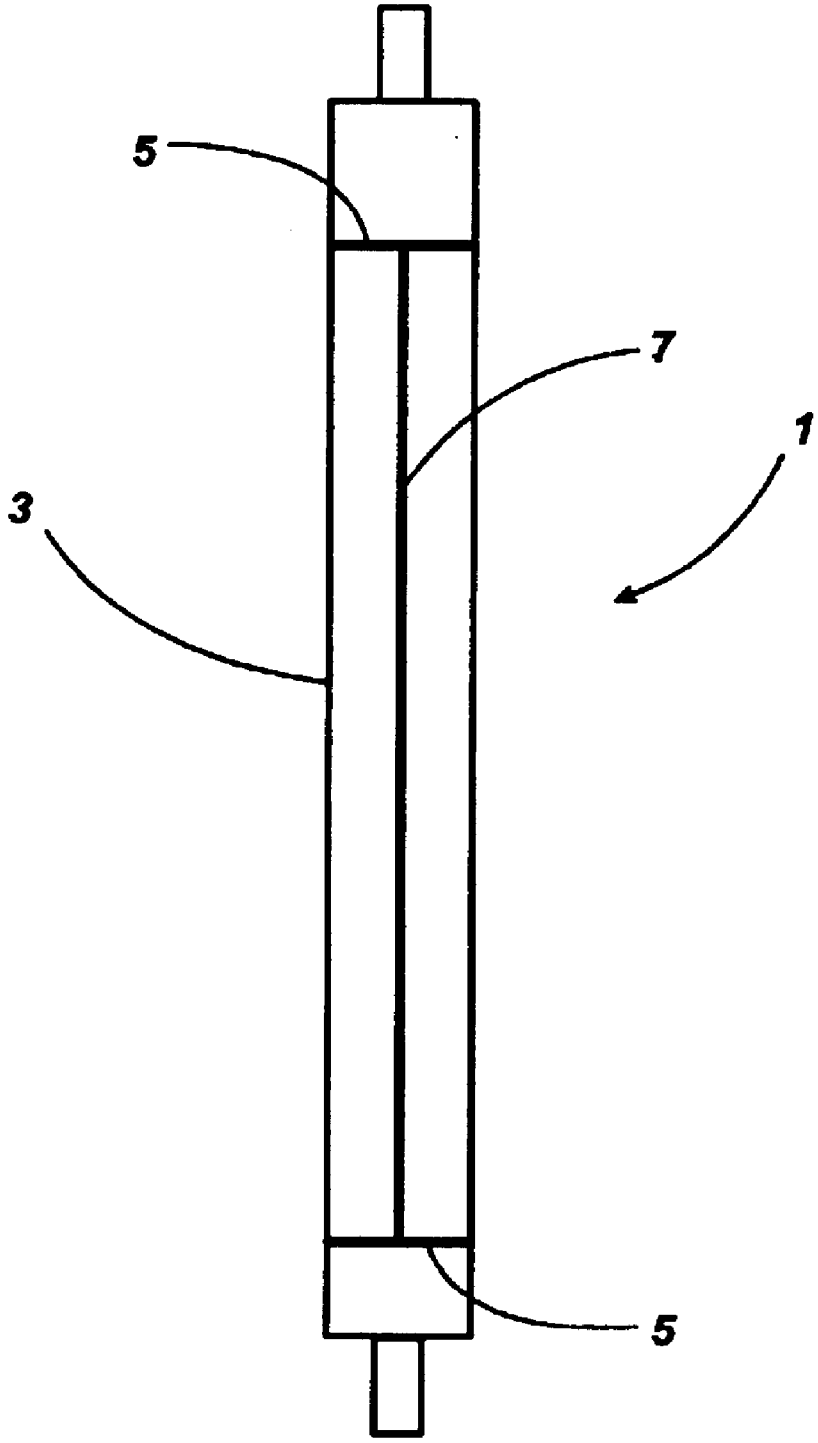
FIG. 1 is an illustration of a ceramic arc tube having an integral starting aid on the exterior surface of the arc tube.

Refractory metal nitrides such as titanium nitride and zirconium nitride are advantageous for integral starting aids because they are conductive, have high melting points, and their thermal expansion coefficients closely match that of the conventional polycrystalline alumina (PCA) arc tubes at the tube's operating temperature of about 1400K. The physical properties of titanium nitride (TiN) and zirconium nitride (ZrN) are compared in Table 1 with tungsten (W) and alumina ($Al_2O_3$). Like tungsten, the metal nitrides, have melting points above that of alumina and possess low electrical resistivity. However, unlike tungsten, the nitrides possess thermal expansion coefficients which closely match that of alumina at 1400K. For this reason, it is expected that starting aids comprised of metal nitrides should outlast pure tungsten and W—$Al_2$ $O_3$ starting aids when subjected to lamp operating conditions and thermal cycling.

TABLE 1

| Material | Linear Expansion Coefficient at 1400 K ($\times 10^{31}$ /K) | Electrical Resistivity at ~25° C. ($\mu\Omega$) | Melting Point (° C.) | Color |
|---|---|---|---|---|
| $Al_2O_3$ | 10.1 | $1 \times 10^{22}$ | 2015 | White |
| TiN | 10.5 | 21.7 | 2930 | Gold |
| ZrN | 119.1 | 13.6 | 2980 | Gold |
| W | 5.4 | 5.7 | 3410 | Black |

The metal nitride starting aid of this invention may be combined in a powdered form with a organic vehicle and applied as an aerosol spray or as an ink using a pen, brush, ink-jet, or similar printing means. Vapor deposition techniques such as vacuum sputtering and chemical vapor deposition (CVD) are also expected to be useful for applying the metal nitride starting aid. However, such means may prove impractical because of the high cost of vapor deposition equipment and the difficulties associated with applying vapor deposition to large-scale manufacturing.

In a preferred method, a prefired PCA arc tube is formed using standard ceramic fabrication techniques, e.g., isopressing or extruding of doped powders into a tubular shape and prefiring the tube in air to remove the binder material. A stripe containing the metal nitride is then applied directly to the porous tube via aerosol spray coating. The aerosol spray consists of the metal nitride and a carrier, e.g., TiN powder in an alcohol/acetone-based carrier. A titanium nitride-containing aerosol spray is commercially available as Traycoat TN Aerosol (ZYP Coatings, Inc., Oak Ridge, Tenn.). The stripe dimensions and shape are controlled by masking the arc tube surface tube except in the area for the desired stripe. The metal nitride may be blended with a ceramic material, preferably aluminum oxide or aluminum oxynitride, to improve the translucency of the starting aid. The prefired, striped arc tube is then sintered to full density, e.g., at 1880° C. for 1 hour in a flowing $N_2$ –8% $H_2$ atmosphere during which the metal nitride simultaneously sinters onto the PCA arc tube. The properties of a TiN starting aid are compared with conventional tungsten and tungsten-alumina starting aids in Table 2. The TiN sinters well without decomposition and provides an electrically conductive stripe. The sintered TiN starting aid adhered well to the PCA with no coloration of the PCA substrate, and yielded an arc tube having acceptable in-line and total transmittance.

TABLE 2

| Material | In-Line Trans. (%) | Total Trans. (%) | Resistance of Stripe @ 25° C. (Ω) | Length (mm) | Width (μm) | Thickness (μm) |
|---|---|---|---|---|---|---|
| PCA/TiN stripe | 5.7 | 90.3 | 9.3 | 20 | 1000 | 10 |
| PCA/W stripe | 4.6 | 94.6 | 1.6 | 75 | 278 | 27 |
| PCA/W-25% $Al_2O$ $cermet_3$ stripe | 5.6 | 94.9 | 21.0 | 76 | 210 | 25 |
| PCA/no stripe | 6.0 | 95.0 | NA | NA | NA | NA |

FIG. 1 is an illustration of the integral starting aid applied to a ceramic arc tube for a high pressure sodium lamp. The arc tube 1 has a tubular body 3 comprised of polycrystalline alumina. The integral starting aid is comprised of longitudinal stripe 7 and transverse stripes 5. The longitudinal stripe extends substantially along the length of the arc tube body and is connected at either end to a transverse stripe 5 which extends circumferentially around the tubular body 3. The starting aid is applied to the exterior surface of tubular body 3 by a conventional ink dispensing means.

While there has been shown and described what are at the present considered the preferred embodiments of the invention, it will be obvious to those skilled in the art that various changes and modifications may be made therein without departing from the scope of the invention as defined by the appended claims.

What is claimed is:

1. An integral starting aid for a high intensity discharge lamp having a ceramic arc tube, the starting aid consisting of a conductive, refractory metal nitride stripe applied to a surface of the arc tube.

2. The starting aid of claim 1 wherein the metal nitride is titanium nitride or zirconium nitride.

3. The starting aid of claim 2 wherein the ceramic arc tube comprises polycrystalline alumina.

4. The starting aid of claim 1 wherein the ceramic arc tube comprises polycrystalline alumina and the metal nitride is titanium nitride.

5. The starting aid of claim 1 wherein the metal nitride is mixed with a ceramic material.

6. The starting aid of claim 5 wherein the ceramic material is aluminum oxide or aluminum oxynitride.

7. The starting aid of claim 1 wherein the ceramic arc tube has a tubular body and the metal nitride stripe comprises a longitudinal stripe extending along the length of the tubular body and connected at each end to a traverse stripe extending circumferentially around the tubular body.

* * * * *